United States Patent [19]

Stoldt

[11] 4,035,530

[45] July 12, 1977

[54] METHOD OF INHIBITING SULFIDATION AND MODIFYING DEPOSITS

[75] Inventor: Stephen H. Stoldt, Dover, N.J.

[73] Assignee: Apollo Chemical Corporation, Whippany, N.J.

[21] Appl. No.: 684,391

[22] Filed: May 7, 1976

[51] Int. Cl.[2] ..... C23C 11/04; C23C 11/08

[52] U.S. Cl. ..... 427/252; 44/67; 60/39.02; 204/181; 427/34; 427/250; 427/423; 428/667

[58] Field of Search ..... 427/248 C, 248 B, 250, 427/252, 383 D, 423, 34; 29/196.6, 198; 204/181; 60/39.02; 44/67

[56] References Cited

U.S. PATENT DOCUMENTS

| | | | |
|---|---|---|---|
| 2,789,049 | 4/1957 | DeLong et al. | 29/196.6 X |
| 3,390,026 | 6/1968 | Cerych et al. | 427/250 X |
| 3,564,565 | 2/1971 | Haberecht et al. | 427/250 X |
| 3,581,491 | 6/1971 | Bornstein et al. | 60/39.02 |
| 3,849,176 | 11/1974 | Asano et al. | 29/196.6 X |

OTHER PUBLICATIONS

Hawley, Condensed Chemical Dictionary, p. 540 (1971).

*Primary Examiner*—Harry J. Gwinnell
*Attorney, Agent, or Firm*—James & Franklin

[57] ABSTRACT

A method of inhibiting hot sulfidation corrosion of a metal surface and modifying the characteristics of any deposit thereon comprises the step of applying to such metal surface and any deposit thereon an inhibitor-modifier. The inhibitor-modifier is a mixture of chromium oxide and manganese oxide, the combustion product of a solution containing a soluble chromium compound and a soluble manganese compound, or a combination of the mixture and combustion product. The mixture and the solution contain chromium and manganese in a molar ratio of at least 1:1.

10 Claims, No Drawings

METHOD OF INHIBITING SULFIDATION AND MODIFYING DEPOSITS

BACKGROUND OF THE INVENTION

The present invention relates to sulfidation (hot corrosion) and deposit formation is gas turbine engines and more particularly to a method of inhibiting such sulfidation and modifying the character of such deposits.

It has been established that sodium sulfate is the agent principally responsible for hot corrosion attack in hot post-flame regions of gas turbine engines. This hot corrosion can severly damage gas turbines and be quite costly.

There are many routes by which sodium compounds can enter the gas paths of a gas turbine or other engine. For example, such compounds may be ingested as a component of a sea water spray (NaC1), as air-borne soil dust, as a deicing chemical, as a fuel (for example, as oil-soluble sodium salts of naphthenic acids), etc. Sulfur is a common constituent of fossil fuels, and even the most highly refined fuels contain some sulfur. Sulfur forms oxides on burning, and these oxides react with the aforementioned sodium compounds under engine operating conditions to give, as one product which is stable at high temperatures, sodium sulfate. Whether the sodium sulfate is formed in the flame, in the hot gas paths, on the alloy surfaces, or by any combination of these processes is immaterial, since its presence on the alloy at appropriate temperature is all that is required for hot corrosion.

Gas turbine parts, especially early-stage nozzles and blades, are subjected to gas temperature sometime approaching 1100° C. These temperatures far exceed the fusion temperatures of pure sodium sulfate (884° C.) and mixtures of sodium sulfate with other salts. Thus, the presence of sodium sulfate thereon, however derived, results in formation of a liquid film of sodium sulfate, or molten mixtures which contain sodium sulfate, on nozzles and blades. This molten salt, and/or its mixtures, are particularly corrosive to the metals of the gas turbine engine, whether they be bare metal, metal protected by a film of its own high-temperature oxidation products, or metal protected with a film of more corrosion resistant material (such as inert aluminum oxide).

Although the process may be complex, it is known that liquid sodium sulfate, by a combination of physical and/or chemical reactions, generates rapid self-sustaining hot corrosion of the metal parts. The molten salt attacks any protective oxide coating present on the metal surface, thus exposing the underlying substrate to accelerated corrosion. The presence of metal sulfides as corrosion products, along with metal oxides, leads to use of the term "sulfidation corrosion" to describe such sodium sulfate-induced corrosion although other terms such as "hot corrosion" or simply "sulfidation" are also used. This sulfidation can increase downtime, repair expense, and loss of generating capacity, and in extreme cases it can necessitate a major overhaul to replace severely damaged internal parts, at great cost to the engine operator.

For the purposes of this invention, it is instructive to differentiate between this sulfidation corrosion and sulfuric acid corrosion. Sulfuric acid corrosion is caused by condensation of sulfuric acid or sulfur trioxide with water on relatively cool portions of boilers, in the temperature range below about 200° C. This is also called "cold-end corrosion", since it occurs in sections of boilers known as the cold end, or those portions where the flue gas has been cooled below the dew point of the sulfuric acid. In this cold-end corrosion, acidic conditions are required, and the process is essentially that of corrosion of metals by warm acid. Generally, cold-end corrosion becomes more severe as gas and/or metal temperatures decrease, at least down to a certain temperature, because more sulfuric acid condenses as the temperatures drop further below the dew point. Anti-corrodents for cold-end corrosion act through an acid neutralization reaction, whereby the anti-corrodents and/or their combustion products neutralize the sulfuric acid to form solid sulfate salts which are not corrosive at these cold-end temperatures because they are solid.

In contrast, the hot corrosion (sulfidation) which is the subject of this invention does not necessarily involve acids. The temperatures at which it occurs are far above those at which sulfuric acid condenses. In fact, sulfidation occurs only in the hottest portions of the engines, in contrast to sulfuric acid corrosion which requires condensation of sulfuric acid and thus occurs only in the color sections of boiler units. Sulfidation requires a temperature above the fusion point of the sodium sulfate (884° C) and its mixtures, since solid salts have little or no corrosive effects in the hot portions of gas turbines. As acidic conditions are not required for sulfidation, anti-corrodents for cold-end corrosion are not necessarily of value as anti-corrodents for sulfidation.

In addition to the sulfidation problem discussed above, gas turbines are also subject to the problem of the adherence of deposits to the same turbine parts. Such deposits may consist only of naturally occurring impurities in the fuel and/or air, or may also include materials traceable to an additive treatment (such as a treatment to reduce sulfidation). These problems may or may not be separate ones. Either one can occur without the other, but interrelationships may also exist. Other problems may also aggravate either or both of these problems. For example, sticky soot (carbon or char) particles are formed by the incomplete combustion of fuel droplets. The sulfur oxides and nonvolatile metal-containing impurities (such as sodium chloride) concentrate on these chars. The chars eventually hit the hot parts of the turbine and stick thereto, thereby holding sodium sulfate or its mixtures in place to melt and then corrode the turbine hot parts. Carbon on the blades can also enhance the corrosivity of sodium sulfate, possibly by acting as a reducing agent to help convert sulfates to sulfides and oxides of the metallic alloy components. In these cases, the carbon is not necessary for corrosion or deposition, but it can enhance these processes and make their effects more severe.

As a practical matter, the two problems (i.e., sulfidation and deposit adherence) are closely intertwined from the point of view of solutions to the problems. Publications (such as that of R.M. Junge, "General Electric Company Experience With Oil Fired Gas Turbines", ASTM Symposium, Atlantic City, Jan. 28, 1964) and patents (U.S. Pat. No. 3,581,491) have described the use of chromium compounds as a sulfidation anti-corrodent. However, while tests reported by General Electric Company showed that sulfidation was controlled, the publication concluded that "the treatment was not useful . . . because it produced an extremely hard and rapidly accumulating deposit" (page 6). Furthermore, the recent Westinghouse Electric Corporation Liquid Fuels Specification MS-576010, Jan. 6, 1975, for gas turbine engines concludes with respect to sulfidation that "for gas turbines operating at gas inlet temperatures above 1200° F, no additive has been found which successfully controls such corrosion without at the same time forming tenacious deposits". Thus, no anti-corrodent for sulfidation is known which does not result in unacceptable deposit formation.

Accordingly, it is an object of the present invention to provide a method of inhibiting sulfidation without introducing unacceptable deposit formation.

It is another object to provide a method of modifying deposit characteristics without increasing sulfidation attack.

It is a further object to provide a method of both inhibiting sulfidation and desirably modifying deposit characteristics.

One object is to provide such a method which enhances the efficacy of a known sulfidation inhibitor.

Another object is to provide such a method which not only enhances the efficiency of a known sulfidation inhibitor, but renders its use acceptable by modifying the character of the deposits resulting from its use.

SUMMARY OF THE INVENTION

It has now been found that the above and related objects of the present invention are attained by the use of manganese compounds in conjunction with a known sulfidation inhibitor, namely, the chromium compounds. Thus, the method of the present invention requires the use of two metals. The first metal, which is known to inhibit sodium sulfate corrosion, but which by itself also forms tenacious deposits, is chromium. The second metal, which by itself aggravates both sulfidation corrosion and deposit formation and adherence when sodium sulfate is present, is manganese.

More particularly, the invention resides in a method of inhibiting hot sulfidation corrosion of a metal surface and modifying the characteristics of any deposit thereon (including those deposits arising substantially out of the presence of sodium sulfate, chromium oxide, or both adjacent the metal surface at elevated temperatures), comprising the step of applying to such metal surface, including any such deposit thereon, a novel sulfidation inhibitor-deposit modifier. The novel inhibitor-modifier is selected from the group consisting of a mixture of chromium and manganese, the combustion product of a solution containing a soluble chromium compound and a soluble manganese compound, and combinations of the mixture and the combustion product. The mixture and the solution contain chromium and manganese in a molar ratio of at least 1:1.

The inhibitor-modifier may be applied by adding it to a fuel as a fuel additive composition, burning the fuel, and exposing the metal surface to the resultant gas stream. Alternatively, it may be injected (for example, as an aqueous solution) into a gas stream formed by the burning of a fuel and directed against the metal surface. Typically at least 0.1 mole of manganese and 0.5 mole of chromium are present per mole of sodium in the deposit or gas stream, preferably at least 0.2 mole of manganese and 1.0 mole of chromium.

The present invention is effective to combat the problems of sulfidation and deposit formation whether they occur individually or in any manner of combination. Furthermore, it provides an unexpected enhancement of the effect of a known sulfidation inhibitor (the chromium compound) by a second material (the manganese compound) which has no sulfidation protection properties itself and which by itself aggravates sulfidation. Thus, a combination of materials according to the present invention provides greater sulfidation inhibition at any constant level of active sulfidation inhibitor (chromium compound) than before and allows a constant level of sulfidation inhibition to be obtained using a lower level of the active sulfidation inhibitor.

Moreover, the inclusion of this second material (the mangenese compound) which by itself increases both sulfidation and deposit adherence to metal or alloy surfaces, unexpectedly modifies beneficially the character of the solids deposited. Specifically, these deposits become self-spalling, more brittle, completely non-adhereing and more readily removed by conventional methods of physical deposit removal such as compressed air, water washing, or nutshell injection. In contrast to results repeatedly observed with single component sulfidation inhibitor materials, the combination inhibitor-modifier does not leave a hard or a tightly held layer on the surfaces to be protected after cooling. The benefits of freedom from deposition on gas turbine performance, efficiency, operating lifetime, maintenance and parts replacement requirements and costs, and reliability are all well documented.

DETAILED DESCRIPTION OF THE PREFERRED EMBODIMENTS

The present invention provides a method of inhibiting hot sulfidation corrosion of a metal surface and modifying the characteristics of a deposit thereon arising substantially out of the presence of sodium sulfate, chromium oxide, or both adjacent the metal surface. It may be used exclusively for sulfidation inhibition or exclusively for deposit characteristic modification or for performing both functions together. Moreover, while the invention is particularly useful in connection with gas turbines where such problems are particularly noticeable and often related, it is obviously equally applicable and useful in connection with metal surfaces, wherever located, subject to either or both problems.

The method of the present invention may be utilized to protect any metals subject to the abovementioned problems. For example, it may be used to protect the highly corrosion resistant superalloys typically found in gas turbines such as the nickle/chromium/cobalt alloy available from Special Metals Corp. under the trade name UDIMET 710. The UDIMET 710 alloy is composed, on a weight basis, of 52% nickel, 18% chromium, 15% cobalt, 4.92% titanium, 3.10% molybenum, 2.58% aluminum, 1.48% tungsten, 0.14% iron, and other elements in amounts less than 0.1% each (actual analysis of one sample). It may also be used to protect less corrosion resistant materials such as the iron/chromium/nickel stainless steels, e.g., AISI Stainless Steel 304 (typically 72% iron, 18.5% chromium and 9.5% nickel) and AISI Stainless Steel 316 (typically 68.75% iron, 17.0% chromium, 12.0% nickel and 2.25% molybdenum). The process is effective regardless of whether the metal involved is a bare metal surface, metal protected by a film of its own high-temperature oxidation products, or metal protected with a film of more corrosion resistant material. The process may be utilized to modify the characteristics of any deposit subsequently forming on the metal surface and/or to modify the characteristics of any deposit already formed thereof, and the deposit may consist only of naturally occurring impurities in the fuel and/or air utilized to form the gas stream impinging on the metal surface or may also include materials traceable to an additive treatment (for example, those which arise sustantially out of the presence of sodium sulfate, chromium oxide or both adjacent the metal surface at elevated temperatures).

The present invention comprises the application to such metal surfaces and any deposits thereon of a novel sulfidation inhibitor-deposite modifier. The aforementioned inhibitor-modifier contains chromium and manganese and may be a mixture of chromium and manganese (preferably a mixture of chromium oxide and manganese oxide), the combustion product of a solution containing a soluble chromium compound and a soluble manganese compound, or a combination of the mixture and the combustion product in various proportions. Thus the inhibitor-modifier may consist essentially of the mixture alone, the combustion product alone, or the combustion of the mixture and the combustion product.

In the mixture form, the chromium and manganese oxides may be supplied from any chromium and manganese sources which, under the elevated temperature conditions required for sulfidation, provide the oxides. The impurities commonly found in industrial grade chromium and manganese oxides do not adversely affect the operation of the present invention, and the use of such industrial grade materials rather than high-purity chemicals is recommended from the viewpoint of economy and ready availability. Naturally where the inhibitor-modifier is to be utilized as a fuel additive composition, the chromium and manganese sources should be soluble in the fuel.

The combustion product form of the inhibitor-modifier may be readily prepared by ashing a solution containing a solvent, a chromium compound and a manganese compound, the chromium and manganese compounds being soluble in the solvent. Typical solvents include, in general, any liquid petroleum distillate fraction such as process oils, diesel or gas turbine fuels, etc., and any aromatic spray bases such as that available from Getty Oil Co. under the trade name AROMATICS 400. The chromium and manganese compounds may be any of the oil-soluble salts of acids such as naphthenic acids, neo-decanoic acid, octoic acid (2-ethylhexanoic acid), fatty acids (e.g., oleic, linoleic and stearic acids), tall oil fatty acids, resin acids, etc. In general, any attempt to apply the solution to a metal surface at the elevated temperatures of operation found in gas turbine applications will automatically result in the formation of the combustion product.

It is to be noted that the combustion product or ash of such a solution has a different appearance from even the most intimate mixture of chromium ash and manganese ash, even at the same relative ratios of chromium and manganese. Furthermore, the combustion product demonstrates better corrosion protection than the simple mixture of ashes. This suggests the possibility of a compound formation between the oxides of the two metals when they are ashed together, possibly the formation of a spinel type compound ($M_2M'O_4$).

While the inhibitor-modifier may be applied to the metal or deposit at any temperature and in any form convertible to the oxide at or upstream of the surfaces to be protected, generally it is applied at elevated temperatures resembling those existing in the hot gas paths of a gas turbine, preferably at a temperature in excess of 650° C. The inhibitor-modifier may be applied by adding it (in fuel-soluble form) to a fuel as a fuel additive composition, burning the additive-containing fuel to produce a gas stream, and exposing the metal surface to the gas stream. Alternatively, the inhibitor-modifier may be applied by burning a fuel to produce a gas stream, injecting the inhibitor-modifier into the gas stream (for example, by injecting into the burner water-soluble compounds thereof which readily decompose in the burner flame to form oxides), and then exposing the metal surface to the gas stream. And, of course, it may be applied as a coating by diverse techniques well recognized in the art, such as electroplating, electrophoresis, flame spray, plasma spray, vapor plating, pack cementation, etc.

While it is necessary that the chromium be present in an amount at least equal to the manganese, on a molar basis, in order to obtain an improvement over the use of chromium alone for sulfidation inhibition, no lower limit has been discernible for the manganese. Thus, it appears that the addition of any appreciable quantity of manganese to the chromium is effective to produce desirable sulfidation inhibition and deposit modification effects. Thus, the lower limit on the manganese content is determined by the desire for deposit modification and the upper limit (relative to the quantity of chromium in the inhibitor-modifier) is fixed by the desire to enhance sulfidation inhibition beyond that attributable to the amount of chromium used. Generally preferred are Cr/Mn molar ratios of 1/1 to 5/2.

While the inhibitor-modifier is effective to reduce corrosion and produce deposit modification at all levels, it is preferred to utilize the inhibitor-modifier at levels, relative to the sodium sulfate in the gas stream or deposit, providing a chromium:sodium ratio of at least 1:1 as at this level and higher levels corrosion by sodium sulfate is completely eliminated. Thus, while the inhibitor-modifier generally contains at least 0.1 mole of manganese and at least 0.5 mole of chromium per mole of sodium present, it preferably contains at least 0.2 mole of manganese and at least 1.0 mole of chromium per mole of sodium present.

EXAMPLES

The following examples illustrate the efficacy of the present invention. All compound and metal ratios are on a molar basis unless otherwise indicated. Unless otherwise inidicated, the chromium source is $Cr_2O_3$ and the manganese source is $Mn_2O_3$.

EXAMPLE I

This example illustrates the beneficial effects on corrosion protection and deposit modification of using the two components of the present invention together on a highly corrosion-resistant alloy, compared with the effects of using either component alone, other metal oxides alone, and other combinations of metal oxides.

PART A

To establish a relatively short laboratory test effective to produce rapid and easily measurable high temperature corrosion on a highly corrosive-resistant specimen, a highly-corrosion-resistant rod of UDIMET 710 superalloy, typically used for reforging stock, was cut into 0.120–0.150 inches thick discs with a carbide wheel. The discs were polished to a high luster using emery cloths of successively finer grit. The discs were then conditioned in an oven for 60 hours at 950° C. This procedure formed a hard, stable, dull-gray coating with a weight gain of about 10 mg (about 2 mg/cm$^2$) and a thickness gain of up to 1 mil.

One of these discs was laid flat in a procelain dish, and $Na_2SO_4$ was added until a thin layer of solid just covered the disc. This sample was heated at 950° C. for 60 hours in an electric furnace in an air atmosphere, the initially solid layer of sodium sulfate becoming a thin fluid layer. This sample, after washing with deionized water and drying, had lost 5 mg., which corresponds to a corrosion rate of about 40 mg/dm$^2$/day (40 mdd) for this sample of about 5 cm$^2$ surface area. The surface was blistered and micrometer measurements indicated a 6 mil thickness increase. The fused salt was yellow and contained 5 mg of dissolved Cr (as $Na_2CrO_4$) plus some dark, acid-insoluble inclusions (probably $Cr_2O_3$). Only a trace of nickel was found, in spite of it being the base metal of the alloy, and the amount of dissolved Cr was therefore taken as another measure of corrosion. The weight loss plus thickness gain are explained by loss of metal and formation of porous, bulky, weakly adhering oxidation products. Thus, rapid and easily measurable corrosion could be produced in a relatively short laboratory test.

PART B

A set of preconditioned discs, as described above, was heated in an electric furnace in an air atmosphere at 950° C. for 86.5 hours in porcelain dishes containing, respectively, CONTROL: No added chemicals, SAMPLE 1: $Na_2SO_4$;

SAMPLES 2–5: $Na_2SO_4$ + one oxide (Na/Metal = 2/1) (ash from one of the following oil-soluble metals: chromium, copper, iron, or manganese);

SAMPLES 6–11: $Na_2SO_4$ + $Cr_2O_3$ + other oxide (Na/Cr/Metal = 2/1/0.4 and 2/1/0.7) (mixtures of ash from oil-soluble chromium with ash from one of the following oil-soluble metals: copper, iron, or manganese).

On cooling, Sample 1 ($Na_2SO_4$) showed severe corrosion (clear yellow solution in water plus insoluble, dark, loose solid). Of the two-component samples, the Sample 2 deposit ($Na_2SO_4$ + $Cr_2O_3$) was hard and dense, and it clung tenaciously to the disc and could be neither broken off with a spatula nor completely washed off. The Sample 3 deposit ($Na_2SO_4$ + $Mn_2O_3$) was a hard, clinging mass; the Sample 4 deposit ($Na_2SO_4$ + CuO) fused to a rock-like mass which completely encased the disc; and the Sample 5 deposit ($Na_2SO_4$ + $Fe_2O_3$) also fused to a hard mass which was difficult to separate from the disc.

The three-component mixtures (Samples 6–11: sodium sulfate, chromium oxide and other oxide) behaved quite differently from the two component mixtures (Samples 2–5). Both the Samples 10 and 11 deposits ($Na_2SO_4$ + $Cr_2O_3$ + $Mn_2O_3$) were brittle and friable. They had already partially separated from the disc, and the remainders were easily lifted off. These deposits crumbled rapidly on simply soaking them in water. The Samples 6–9 deposits ($Na_2SO_4$ + $Cr_2O_3$ + either CuO or $Fe_2O_3$) were not as readily removed from the metal while dry, but they also crumbled on soaking in water.

Changes in weights and thicknesses of the samples and a control after washing with deionized water and drying, and quantities of soluble chromium found in the deposits, are recorded in Table I. The following data and observations pertain to the discs after washing with deionized water and drying.

Sample 1 ($Na_2SO_4$) lost 14.6 mg, corresponding to a very high corrosion rate of about 81 mdd. The surface was irregular and exhibited the greenish discoloration typical of sulfidation corrosion. The bulky, porous, blistered, irregular surface accounts for the slight gain in thickness accompanying the loss in weight. The clear yellow solution, formed on dissolving the yellow solid and filtering, contained 17 mg of Cr by atomic absorption spectroscopy, in close agreement with the 14.6 mg weight loss of the disc.

As illustrated by Sample 2, adding 0.50 mole of $Cr_2O_3$ to the $Na_2SO_4$ did give corrosion protection, but it was not possible to remove all of this mixture from the surface of the metal disc after the test. Thus, the 3.5 mg weight gain includes some of this added material, and the metal disc itself may actually have lost weight. The fact that there was no thickness increase accompanying the weight gain supports this possibility. This formation of hard deposits with $Na_2SO_4$ and $Cr_2O_3$ agrees with the results from the General Electric Company publication cited above. Water-soluble Cr was found (143 mg), but its quantity is irrelevant (since it was obviously formed mainly from the added $Cr_2O_3$) except to show that the added $Cr_2O_3$ is chemically reacting in the process of providing corrosion protection. As illustrated by Sample 3, adding 0.50 mole of $Mn_2O_3$ to the $Na_2SO_4$ gave an increase in corrosion, even over that of $Na_2SO_4$ by itself. The metal disc had several hundred milligrams of deposit thereon which could not be removed either mechanically or by washing. The presence of 47.3 mg of dissolved Cr in the water washings in this case, compared with 17 mg from $Na_2SO_4$ alone, clearly establishes greater corrosion with $Mn_2O_3$ added to $Na_2SO_4$ than with $Na_2SO_4$ alone (or for that matter with $Mn_2O_3$ alone since these gas turbine alloys are inert to oxides of manganese at temperatures below 2000° F). No dissolved manganese (<0.1 mg) could be detected in the water washings.

As illustrated by Sample 4, adding 0.50 mole of $Fe_2O_3$ to the $Na_2SO_4$ gave about double the weight loss observed with $Na_2SO_4$ alone, yet there was no thickness change of the metal disc, again indicating a weak, porous surface from within which the alloy metal had been eaten away.

As illustrated by Sample 5, adding 0.50 mole of CuO to the $Na_2SO_4$ gave a weight increase, even though dissolved chromium from the alloy was also detected. Since, as mentioned above, this mixture had formed a rock-like mass which was extremely difficult to dislodge, it appears that copper-containing materials remained on and/or in the alloy specimen. The disc had a brown, rusty appearance.

The results of Samples 2–5 show that adding a single metal oxide to sodium sulfate can have undesirable effects on gas turbine alloys at elevated (operating) temperatures. Three of the four oxides (all but $Cr_2O_3$) compounded the corrosion problems over those observed with $Na_2SO_4$ alone. All four oxides, including the $Cr_2O_3$ one which has long been known as a sulfidation inhibitor, also caused more or less severe deposition problems as well.

The three-component mixtures (Samples 6-11: $Na_2SO_4 + Cr_2O_3$ + one of the other three oxides) showed both expected similarities and unexpected differences, compared to the two-component mixtures (Samples 2–5: $Na_2SO_4$ + one of the four oxides alone). Thus, Samples 6 and 7 ($Na_2SO_4 + Cr_2O_3 + Fe_2O_3$) gave a large weight loss of the metal disc, as did Sample 4 ($Na_2SO_4 + Fe_2O_3$), and soluble Cr, although not nearly as much as did Sample 2 ($Na_2SO_4 + Cr_2O_3$). Apparently the tendency of the $Cr_2O_3$ to protect against sodium sulfate attack (by $Na_2CrO_4$ formation) cannot completely overcome the corrosive tendency of the $Na_2SO_4 + Fe_2O_3$ mixture described above.

Samples 8 and 9 ($Na_2SO_4 + Cr_2O_3 + CuO$) gave not only small weight increases and larger quantities of soluble Cr, as did Sample 2 ($Na_2SO_4 + Cr_2O_3$), but also large thickness increases and brownish surface discolorations, as did Sample 5 ($Na_2SO_4 + CuO$). Again, the corrosive and deposit-forming tendencies of the $Na_2SO_4 + CuO$ mixture at least partially overcame the protection against sulfidation corrosion afforded by the $Cr_2O_3$.

Among these three-component mixtures, only Samples 10 and 11 ($Na_2SO_4 + Cr_2O_3 + Mn_2O_3$) gave results which were not combinations of results obtained with the two respective oxide plus $Na_2SO_4$ mixtures. While the corrosion- and deposition-promoting CuO or $Fe_2O_3$ were antagonistic to the corrosion-inhibiting $Cr_2O_3$ when they were added to $Na_2SO_4 + Cr_2O_3$ mixtures (as in Samples 6–9) $Mn_2O_3$ added to the $Na_2SO_4 + Cr_2O_3$ produced dramatic improvement (as in Samples 10 and 11). The deposit was brittle and had actually separated itself from the disc during the cooling process. Simple water washing removed the entire deposit to give a clean yellow liquid, which contained a suspension of very fine particles. The particles from Samples 10 and 11 were the only ones to pass through even a Whatman No. 42 (fine) filter, while a No. 41 (coarse) filter trapped all solids from the companion runs. The discs of Samples 10 and 11 showed only slight gains in weight and thickness, comparable to those of the blank (disc with no chemicals added), and a smooth surface with no adhering deposits, compared to the disc of Sample 2 ($Na_2SO_4$ and $Cr_2O_3$). The water washings of Samples 10 and 11 contained more soluble chromium than did the other three-component mixtures (Samples 6–9), and they also contained soluble manganese, in contrast to the water washings of Sample 3 ($Na_2SO_4$ and $Mn_2O_3$). Thus, some chemical interaction of the chromium and manganese, when used together as in the present invention and Samples 10 and 11, is indicated.

To summarize, the combination of materials of the present invention (Samples 10 and 11) provides corrosion protection and deposit character modification properties superior to that obtained from any single material or any other combination of materials that was studied. The superior deposit modification properties of the present invention are shown by deposit separation from the metal surface, ease of water washing, and fineness of the easily suspended particles, compared with results described above, for Samples 1–9 and in the earlier literature for use of single oxide components. These properties are of great benefit to gas turbine users, since maintaining blade cleanliness will be easier with the materials of this invention. The deposits separate well from the alloy, and only slight water washing, at most, is required to remove any remaining solid deposits.

TABLE I

HIGH TEMPERATURE CORROSION TEST (950° C, 86.5 HOURS) OF UDIMET 710 WITH SODIUM SULFATE AND OXIDES[a]

| Sample No. | Added Chemicals | Molar Ratios of Metals | Weight Change, mg. | Thickness Change, mils | Soluble Chromium, mg. |
|---|---|---|---|---|---|
| | None (Control) | — | + 4.0 | +0.2 | — |
| 1 | $Na_2SO_4$ | — | −14.6 | +1.1 | 17.0 |
| 2 | $Cr_2O_3 + Na_2SO_4$ | Cr:Na = 0.5/1 | + 3.5 | −0.1 | 142.75 |
| 3 | $Mn_2O_3 + Na_2SO_4$ | Mn:Na = 0.5/1 | +795.7 | [b] | 47.25 |
| 4 | $Fe_2O_3 + Na_2SO_4$ | Fe:Na = 0.5/1 | −31.1 | 0 | 8.0 |
| 5 | $CuO + Na_2SO_4$ | Cu:Na = 0.5/1 | +23.6 | +4.5 | 12.8 |
| 6 | $Cr_2O_3 + Fe_2O_3 + Na_2SO_4$ | Cr:Fe:Na = 0.5/0.2/1 | −18.5 | +0.4 | 94.75 |
| 7 | $Cr_2O_3 + Fe_2O_3 + Na_2SO_4$ | Cr:Fe:Na = 0.5/0.35/1 | −31.6 | +1.3 | 85.75 |
| 8 | $Cr_2O_3 + CuO + Na_2SO_4$ | Cr:Cu:Na = 0.5/0.2/1 | + 1.9 | +5.8 | 120.0 |
| 9 | $Cr_2O_3 + CuO + Na_2SO_4$ | Cr:Cu:Na = 0.5/0.35/1 | + 7.5 | +3.4 | 106.0 |
| 10 | $Cr_2O_3 + Mn_2O_3 + Na_2SO_4$ | Cr:Mn:Na = 0.5/0.2/1 | + 4.5 | +0.4 | 145.75 |
| 11 | $Cr_2O_3 + Mn_2O_3 + Na_2SO_4$ | Cr:Mn:Na = 0.5/0.35/1 | + 7.0 | +0.9 | 106.0 |

[a]Discs were preconditioned for 60 hours at 950° C.
[b]Not measurable because of highly irregular surface, caused by some solids baking onto the disc.

EXAMPLE II

In order to establish the generality of the results of Example I, this example illustrates the beneficial effects on corrosion protection and deposit modification of using the two components of the present invention together, compared with the use of either component alone, on alloy samples with less corrosion resistance than the "superalloys" of Example I. Discs (3/16 inch thick, 13/16 inch diameter) were cut from an A.I.S.I. type 316 stainless steel rod and polished as in Example I. The discs were first weighed and micrometered, and then stood on edge in crucibles. The chemicals were next added so as to cover about ⅓ of the disc. After heating for 24 hours at 927° C, the specimens were slowly cooled, washed with deionized water, dried in warm air, then reweighed and remeasured, the results being recorded in Table II. (The lower corrosion resistance of these stainless steels, compared with the superalloys, allowed more rapid determination of corrosion and of corrosion inhibition.)

The systems studied were

CONTROL: No added chemicals.

SAMPLE 12: $Na_2SO_4$;

SAMPLE 13: $Na_2SO_4 + Cr_2O_3$ (ash from oil-soluble chromium) (Na/Cr + 1/1);

SAMPLE 14: $Na_2SO_4 + Mn_2O_3$ (ash from oil-soluble manganese) (Na/Mn = 1/1); and SAMPLE 15: $Na_2SO_4 + Cr_2O_3 + Mn_2O_3$ (ash from dissolved mixture of oil-soluble chromium and manganese, with Cr/Mn = 2.468) (Na/Cr/Mn = 1/1/0.4052).

Sample 12 ($Na_2SO_4$) formed a dark, dull surface above the $Na_2SO_4$, similar in appearance and thickness change to the control. The $Na_2SO_4$ fused to large, clear, yellow and brown crystals (the color being due to dissolved components of the metal), which were completely water-soluble after prolonged washing, and the steel in contact with it showed a green coloration (due to surface oxidation of Cr from the steel). Losses in both thickness beneath the $Na_2SO_4$ and in weight were observed.

Sample 13 ($Na_2SO_4 + Cr_2O_3$) formed a granular solid which yielded a yellow solution and a green solid. The disc had picked up green solid from the $Cr_2O_3$, to give a rough surface which could be neither washed off nor wiped off. The large thickness increase reflected this added material, but the weight gain was smaller than that with Sample 15 ($Na_2SO_4 + Cr_2O_3 + Mn_2O_3$), indicating less protection from $Cr_2O_3$ alone against loss of steel by reaction with $Na_2SO_4$.

Sample 14 ($Na_2SO_4 + Mn_2O_3$) formed a fused, coarse, granular solid which clung to the disc. Water dissolved some of it, but the remaining hard, dark solid had to be mechanically broken up to free the disc. This disc also had some green coloration just below the surface level of the solids, indicating corrosion although not as intense as in Sample 12 ($Na_2SO_4$). Spalling above the solids surface and blistering below were present. Weight loss and thickness increase indicated corrosion which produced bulky products.

Sample 15 ($Na_2SO_4 + Cr_2O_3 + Mn_2O_3$) also formed a fused, coarse, granular solid, but this solid had separated so well from the metal that the disc could be lifted out without even disturbing the solid. Water instantly gave a yellow solution, and the solid cake crumbled without agitation merely on soaking and only a little remained undissolved. The disc resembled the control, with very little apparent difference between its upper and lower portions, indentical thickness changes, and a slight weight gain.

The results of this example with stainless steel discs closely parallel those of Example I with superalloy discs.

TABLE II

High Temperature Corrosion Test (927° C, 24 Hours) of Type 316 Stainless Steel With Sodium Sulfate and Oxides

| Sample No. | Added Oxide | Molar Ratios of Metals | Weight Change, mg | Thickness Top, mils[b] | Changes Bottom, mils |
|---|---|---|---|---|---|
| | Alone (Control) | [a] | +6.7 | +0.6 | +0.4 |
| 12 | — | Na | −8.3 | +0.5 | −0.2 |
| 13 | $Cr_2O_3$ | Na/Cr = 1/1 | +1.4 | +0.3 | +1.0 |
| 14 | $Mn_2O_3$ | Na/Mn = 1/1 | −19.7 | +0.4 | +1.3 |
| 15 | $Cr_2O_3 + Mn_2O_3$ | Na/Cr/Mn = 1/1/0.4 | +2.7 | +0.5 | +0.5 |

[a]Blank, no $Na_2SO_4$ or oxides.
[b]All thickness changes were equivalent, within the uncertainties of measurement, at the tops, which were not in contact with any chemicals.

EXAMPLE III

PART A

Planchets made of A.I.S.I. Type 304 stainless steel were used in this example. The planchets were convenient, since they had flat bottoms with parallel faces (which made thickness measurements more reliable) and also served as dishes to contain the corrodents and anti-corrodent/corrodent mixtures. The thickness of the bottom (nearest 0.1 mil) and the weight (nearest 0.1 mg) of the Type 304 planchets were first measured. One planchet was then dosed with 0.71 g (5 millimoles) of anhydrous $Na_2SO_4$, others with equivalent quantities of those materials to be tested for corrosion inhibiting properties. Other planchets were treated with 2/1, 1/1, and ½ mole ratio mixtures of $Na_2SO_4$ and each inhibitor. An empty planchet was also included to serve as a standard or control against which to measure the effectiveness of the inhibitor. The entire set was heated 3 hours at 927° C., then cooled slowly in order to prevent thermal shock from cracking off oxide coatings and making weight and thickness changes meaningless. The deposits were removed by washing with deionized water, the nature of the deposits (powdery, fused, color changes, ease of removal from surface, etc.) being noted. The planchets were dried in warm air, cooled, and weights and thicknesses were again determined. The changes in weight and thickness are reported in Table III.

The tests are grouped for this and the several examples which follow. Some test results are presented in more than one of these examples, in order for each example to present an independent set of data.

A test set usually consists of: an untreated standard or control which has gained a few mg. and a fraction of a mil, due to formation of the stable protective oxide coating; a $Na_2SO_4$-treated sample which has lost both weight and thickness, due to the continual dissolution of protective oxide coating by molten $Na_2SO_4$; an inhibitor-treated sample; and several samples treated with $Na_2SO_4$ and inhibitor(s) in varying ratios, the conditions of which samples indicate the effectiveness of the inhibitor.

PART B

The procedure of Part A was used to evaluate the effectiveness of different ratios of $Na_2SO_4$ and SET 1: $Cr_2O_3$ (ash from oil-soluble chromium), SET 2: $Mn_2O_3$ (ash from oil-soluble manganese), and SET 3: $Cr_2O_3 + Mn_2O_3$ (Cr/Mn = 5/2) (ash prepared by grinding and mixing Set 1 and Set 2 ashes).

In Set 1, the $Cr_2O_3$ reduced corrosion at mole ratio Na/Cr = 2/1 (Sample 19), eliminated corrosion at Na/Cr = 1/1 and 1/2 (Samples 20 and 21), and caused no corrosion when present by itself (Sample 18). In all of the mixtures of $Na_2SO_4$ and $Cr_2O_3$ (Samples 19–21), the $Cr_2O_3$ did leave a tenacious green layer on the surface of the planchets.

In Set 2 manganese ash by itself (Sample 24) promoted corrosion of the planchets. The combination of Mn ash ($Mn_2O_3$) with $Na_2SO_4$, at mole ratios Na/Mn of 2/1, 1/1 and 1/2 (Samples 25–27) caused much more severe corrosion. Metal not in contact with the solids formed, or had formed on it, gleaming crystals. This surface spalled off, and the crystals were insoluble in water. The metal in contact with the Mn ash + $Na_2SO_4$ mixtures (Samples 25–27) had a blistered, uneven surface. The solids had fused at 1700° F to a dense mass which could not be easily removed from the metal. Weight loss from the planchet was high (100 to 300 mg from a 3.5 g planchet); the blistered surface made thickness measurements meaningless.

In Set 3, the $Cr_2O_3 + Mn_2O_3$ mixture was maintained at a constant Cr/Mn ratio (Cr/Mn = 5/2), and blended with $Na_2SO_4$ on various Na/Cr mole ratio bases. The $Cr_2O_3 + Mn_2O_3$ (Sample 31) was a more effective corrosion inhibitor than the $Cr_2O_3$ alone (Sample 19) at an equivalent low chromium level (Na/Cr = 2/1), while at higher chromium levels (Na/Cr = 1/1 or 1/2), the $Cr_2O_3 + Mn_2O_3$ mixture alone (Sample 30) or with $Na_2SO_4$ (Samples 32 or 33) resulted in the planchets being in the same condition as the control (Sample 28: no chemicals added). Inclusion of the $Mn_2O_3$ with the $Cr_2O_3$ obviously was beneficial.

The $Cr_2O_3 + Mn_2O_3$ mixture (Samples 30–33) had several other advantages over $Cr_2O_3$ (Samples 18–21). The $Cr_2O_3$, and all mixtures of this with $Na_2SO_4$, did not adhere at all to the metal (Set 3), while $Cr_2O_3$ and $Na_2SO_4 + Cr_2O_3$ mixtures all left an uneven green film on the metal (Set 1) which could potentially impair performance efficiency in a gas turbine engine. Also, in the Set 3 tests, all the $Na_2SO_4 + Cr_2O_3 + Mn_2O_3$ mixtures (Samples 31–33) had fused, in contrast to the Set 1 tests in which the $Na_2SO_4 + Cr_2O_3$ mixtures (Samples 19–21) had fused only partially or not at all depending on $Cr_2O_3$ concentration. This indicates that the superior observed protection afforded by the $Cr_2O_3 + Mn_2O_3$ mixture is not due simply to raising the $Na_2SO_4$ fusion point above a test temperature.

The wide range of sodium to metal concentration ratios over which the $Cr_2O_3 + Mn_2O_3$ mixtures were effective, and the lack of any deleterious effects from over-treatment or from treatment in the absence of $Na_2SO_4$, are further advantages of the present invention.

In addition, the superior corrosion protection and deposit modification properties of the $Cr_2O_3 + Mn_2O_3$, over those of $Cr_2O_3$ alone or $Mn_2O_3$ alone, are again evident from the results of the tests described in this example.

TABLE III

HIGH TEMPERATURE CORROSION TESTS (927° C) OF TYPE 304 STAINLESS STEEL WITH SODIUM SULFATE AND OXIDES

| Set No.[a] | Sample No. | Mole Ratio Cr | Mole Ratio Mn | Mole Ratio Na | Weight Change, mg | Thickness Change, mils |
|---|---|---|---|---|---|---|
| 1 | 16 | — | — | — | +3.6 | +0.4 |
| | 17 | — | — | 1 | +41.6 | +3.0 |
| | 18 | 1 | — | — | +4.6 | +0.5 |
| | 19 | 0.5 | — | 1 | −8.3 | +0.2 |
| | 20 | 1 | — | 1 | −13.6 | +0.8 |
| | 21 | 2 | — | 1 | −17.7 | +0.5 |
| 2 | 22 | — | — | — | +4.7 | +2.0 |
| | 23 | — | — | 1 | +1.8 | +0.3 |
| | 24 | — | 1 | — | −10.4 | [b] |
| | 25 | — | 0.5 | 1 | −163.4 | [b] |
| | 26 | — | 1 | 1 | −281.1 | [b] |
| | 27 | — | 2 | 1 | −361.9 | [b] |
| 3 | 28 | — | — | — | +3.6 | +0.6 |
| | 29 | — | — | 1 | −10.1 | +0.1 |
| | 30 | 1 | 0.4 | — | +4.9 | +0.4 |
| | 31 | 0.5 | 0.2 | 1 | +9.7 | +1.2 |
| | 32 | 1 | 0.4 | 1 | +5.2 | +1.2 |
| | 33 | 2 | 0.8 | 1 | [c] | +0.1 |
| 4 | 34 | 0.5 | — | 1 | +34.5 | +5.5 |
| | 35 | 0.5 | 0.167 | 1 | +13.0 | +0.6 |
| | 36 | 0.5 | 0.25 | 1 | +21.0 | +0.7 |
| | 37 | 0.5 | 0.5 | 1 | [c] | +0.5 |
| | 38 | 0.5 | 1 | 1 | [c] | +1.0 |
| 5 | 18 | 1 | — | — | +4.6 | +0.5 |
| | 30 | 1 | 0.4[d] | — | +4.9 | +0.4 |
| | 41 | 1 | 0.4[e] | — | [c] | +0.9 |
| 6 | 19 | 0.5 | — | 1 | −8.3 | +0.2 |
| | 31 | 0.5 | 0.2[d] | 1 | +9.7 | +1.2 |
| | 42 | 0.5 | 0.2[e] | 1 | +2.5 | +0.4 |
| 7 | 20 | 1 | — | 1 | −13.6 | +0.8 |
| | 32 | 1 | 0.4[d] | 1 | +5.2 | +1.2 |
| | 43 | 1 | 0.4[e] | 1 | −0.2 | +0.8 |
| 8 | 21 | 2 | — | 1 | −17.7 | +0.5 |
| | 33 | 2 | 0.8[d] | 1 | [c] | +0.1 |
| | 44 | 2 | 0.8[e] | 1 | +9.4 | +1.3 |
| 9 | 45 | — | — | 1 | +1.5 | −0.2 |
| | 46 | 1 | — | 1 | −8.1 | +0.4 |
| | 47 | — | 1 | 1 | −278.9 | +3.2 |
| | 48 | 1 | 0.4 | 1 | −2.1 | +0.5 |

[a]Set 4 corrosion test run for 24 hours, all others for 3 hours.
[b]Not measurable because of highly irregular surface, caused by some solids baking onto the disc.
[c]Not measurable because of some oxide scale falling off specimen.
[d]Mixture of ashes from Cr and from Mn.
[e]Ash from solution of Cr + Mn.

EXAMPLE IV

The procedure of Example III, Part A, modified only to provide a 24-hour corrosion test rather than a 3-hour corrosion test, was used to evaluate the range of chromium-to-manganese concentration ratios (at a constant Na/Cr mole ratio of 2/1) over which the components of this invention would be effective in inhibiting sulfidation corrosion and in modifying deposit character.

The Set 4 data shows that a mole ratio of Cr to Mn of at least 1/1 (Samples 35–37) was necessary to give corrosion protection superior to Cr alone at the same Na/Cr ratio. Mole ratios of Cr to Mn of less than unity (to 1/2) (Sample 38) also gave corrosion protection, relative to $Na_2SO_4$ by itself, but no special benefits over $Cr_2O_3$ alone (Sample 34) were observed.

Concerning deposit modification, Cr/Mn = 1/1 (Sample 37) was also the lowest ratio that improved deposit separation from the metal. Mole ratios of Cr to Mn of 2/1 and 3/1 (Samples 36 and 35) gave much improved separation from the surface. No lower limit of Mn content in the mixture was found; that is, even the smallest manganese addition to the chromium improved deposit separation, relative to the separation of the chromium deposit alone, either in the presence or in the absence of sodium sulfate.

EXAMPLE V

This example illustrates that the ingredients of the present invention (Cr and Mn) need not be added together or simultaneously, that adding the ingredients together produces even greater benefits than does adding them separately, and that either addition system produces greater sulfidation protection, and easier and more complete deposit removal, than that obtained from the same quantity of Cr, at any given Na/Cr ratio.

Two ashes of the same composition but produced by different methods of production were compared. In one case (Samples 41–44), oil-soluble chromium and manganese (Cr/Mn = 5/2 mole ratio) were first mixed in a common solvent (AROMATICS 400), then the resulting solution was ashed. In the other case (Samples 30–33), the oil-soluble chromium and manganese were ashed separately, then the ashes were ground and mixed (Cr/Mn = 5/2 mole ratio). The ash from the solution was different in appearance from the mixture prepared from the separate ashes of chromium and manganese, no matter how thoroughly the latter mixture was blended.

Corrosion tests were performed according to the procedure of Example III, Part A, using these two mixtures (Samples 30–33 and 41–44) and $Cr_2O_3$ alone (Samples 18–21). Each of the two mixtures and the $Cr_2O_3$ were studied by themselves and with $Na_2SO_4$ at Na/Cr mole ratios of 2/1, 1/1, and 1/2. Thus, at each Na/Cr ratio (Set 6: 2/1; Set 7: 1/1; Set 8: 1/2), and also in the absence of $Na_2SO_4$ (Set 5), there were three inhibitors: ash from Cr + Mn solution, mixture of separate ashes from Cr and Mn, and ash from Cr alone.

At each Na/Cr ratio (Sets 6–8), the corrosion protection afforded decreased in the order: ash from Cr + Mn solution>mixture of ashes from Cr and Mn>ash from Cr. Without $Na_2SO_4$ (Set 5), there was no corrosion from any of the three ashes. At each Na/Cr ratio (Sets 6–8), and also in the absence of $Na_2SO_4$ (Set 5), the ease and completeness of deposit removal decreased in the same order.

EXAMPLE VI

This example illustrates the superiority of the $Cr_2O_3$ + $Mn_2O_3$ combination over either $Cr_2O_3$ or $Mn_2O_3$, both in corrosion protection and in deposit modification, for a stainless steel.

The procedure of Example III, Part A, was used to test the following systems in Set 9:

SAMPLE 45: $Na_2SO_4$;

SAMPLE 46: $Na_2SO_4 + Cr_2O_3$ (ash from oil-soluble chromium) (Na/Cr = 1/1);

SAMPLE 47: $Na_2SO_4 + Mn_2O_3$ (ash from oil-soluble manganese) (Na/Mn = 1/1); and SAMPLE 48: $Na_2SO_4 + Cr_2O_3 + Mn_2O_3$ (a mixture of the two ashes from the oil-soluble metals) (Na/Cr/Mn = 1/1/0.4).

Most, but not all, of the deposit of Sample 46 ($Na_2SO_4 + Cr_2O_3$) could be washed off the planchet. The deposit of Sample 47 ($Na_2SO_4 + Mn_2O_3$) severely blistered the metal of the planchet in contact with it and spalled off the metal above it; it fused solid, would not wash off, and had to be pried off. On the other hand, the deposit of Sample 48 ($Na_2SO_4 + Cr_2O_3 + Mn_2O_3$) separated readily from the planchet without washing. On water washing, Samples 45, 46 and 48 gave yellow solutions, indicating chemical reaction. $Na_2SO_4$ reacted with the metal of the planchet when no anti-corrodent was present (Sample 45), while it reacted with the $Cr_2O_3$ when the latter was added (Samples 46 and 48) since the metal surfaces in the latter samples were not corroded.

EXAMPLE VII

This example illustrates the effectiveness of the inhibitor-modifier of the present invention under the conditions of their intended application in a field trial, in an operating gas turbine at a major utility studied in a marine environment.

An oil-soluble mixture of chromium and manganese was prepared from the oil-soluble soaps of these respective metals, using an aromatic spray base as the common solvent. The solution contained on a weight basis 3.5% chromium and 1.5% manganese, giving a molar ratio of manganese to chromium of 0.4. This product was injected into the fuel lines of two operating General Electric Model 5000 gas turbines at an average rate of one gallon of product per 3160 gallons of fuel, giving concentrations of chromium and manganese in the fuel of 12.6 and 5.4 parts per million by weight, respectively.

After more than a thousand operating hours (1140 hours in one turbine and 1400 hours in the other), the turbine hot parts were inspected by the utility's personnel. These hot parts showed no corrosion or deposits, and no undesirable side effects could be found. The condition of these internal turbine parts was rated as excellent.

In addition to the techniques previously mentioned for applying the chromium and manganese, other application techniques well known to those skilled in the art may be utilized. For example, the metals may be applied as an oil-based dispersion of the oxides of chromium and manganese. This is a common way to supply different metal oxides as fuel additives. The dispersion is injected into the fuel as the fuel is pumped to the burners. This form of additive is most commonly used with the denser and more viscous fuels (Bunker C, No. 6, crude oil, residual fuel, No. 4-GT) and these are the fuels most likely to be contaminated with appreciable levels of sodium. In this system, salts or other oxides of chromium and manganese may be dispersed in a petroleum carrier. In addition, there may be materials to disperse the solids, anti-settling and viscosity control agents, etc.

Another method of application is as a water-based system, either a water-soluble or water-dispersible system. The water-soluble salts, such as acetates and nitrates, can be used in the water-soluble system. The oxides or insoluble salts can be used in the water-dispersible system. Either form can be injected into the fuel line before the burner or into the combustion chamber by means of a separate injector.

Combinations of these methods may also be used to supply the metals. An oil-based system may contain one metal in oil-soluble form and the other metal as an oxide which is dispersed in the oil-based system. Similarly, a water-based system may contain one metal as a soluble salt and the other metal as an insoluble salt or oxide which is dispersed in the water-based system. Also, a water-in-oil or oil-in-water emulsion may be prepared from various sources of the two metals and used in that form, either by injection into the fuel line or by injection into the combustion chamber through a separate injector.

To summarize, the present invention provides a method of inhibiting hot sulfidation corrosion of a metal surface, modifying the characteristics of any deposit thereon, or doing both together. It furthermore not only enables the practical use of a known sulfidation inhibitor (which was heretofore not practical for use due to the tenacious deposit resulting from such use), but also improves the efficiency of the known sulfidation inhibitor, thus permitting its use at lower levels to provide the same level of sulfidation inhibition or at the same level to provide enhanced sulfidation inhibition.

Now that the preferred embodiments of the present invention have been described in detail, various modifications and improvements thereon will become readily apparent to those skilled in the art. Accordingly, the spirit and scope of the present invention is to be limited only by the appended claims, and not by the foregoing disclosure.

I claim:

1. A method of inhibiting hot sulfidation corrosion of a metal surface and rendering any deposit thereon more readily removable, comprising the step of applying to such metal surface, including any such deposit thereon, an inhibitor-modifier selected from the group consisting of 1. a mixture of chromium and manganese, said mixture containing chromium and manganese in a molar ratio of at least 1:1,
2. the combustion product of a solution containing a soluble chromium compound and a soluble manganese compound, said solution containing chromium and manganese in a molar ratio of at least 1:1,
3. a combination of said mixture and said combustion product.

2. The method of claim 1 wherein said inhibitor-modifier consists essentially of said mixture.

3. The method of claim 1 wherein said inhibitor-modifier consists essentially of said combustion product.

4. The method of claim 1 wherein said inhibitor-modifier consists essentially of said combination of said mixture and said combustion product.

5. The method of claim 1 wherein said inhibitor-modifier is applied by adding said inhibitor-modifier to a fuel as a fuel additive composition, burning said additive-containing fuel to produce a gas stream, and exposing the metal surface to said gas stream.

6. The method of claim 1 wherein said inhibitor-modifier is applied by burning a fuel to produce a gas stream, injecting said inhibitor-modifier into said gas stream, and exposing the metal surface to said gas stream.

7. The method of claim 1 wherein said deposit includes sodium and said inhibitor-modifier contains at least 0.1 mole of manganese and at least 0.5 mole of chromium per mole of sodium present in said deposit.

8. The method of claim 7 wherein said inhibitor-modifier contains at least 0.2 mole of manganese and at least 1.0 mole of chromium per mole of sodium present in said deposit.

9. The method of claim 1 wherein said inhibitor-modifier is applied as a part of a sodium-containing gas stream eventually impinging on the metal surface and any deposit thereon and in an amount providing at least 0.1 mole of manganese and at least 0.5 mole of chromium per mole of sodium present in said gas stream.

10. The method of claim 9 wherein said inhibitor-modifier is applied in an amount providing at least 0.2 mole of manganese and at least 1.0 mole of chromium per mole of sodium present in said gas stream.

* * * * *

Disclaimer and Dedication 4,035,530.—*Stephen H. Stoldt,* Dover, N.J. METHOD OF INHIBITING SULFIDATION AND MODIFYING DEPOSITS. Patent dated July 12, 1977. Disclaimer and Dedication filed Mar. 10, 1983, by the assignee, *Economics Laboratory, Inc.*

Hereby enters this disclaimer to all claims and dedicates to the Public the entire term of said patent.

[*Official Gazette October 4, 1983.*]